US009199120B2

(12) United States Patent
Hutchison

(10) Patent No.: US 9,199,120 B2
(45) Date of Patent: Dec. 1, 2015

(54) MOUTH GUARD FOR INCREASING STRENGTH AND STAMINA

(76) Inventor: Michael C. Hutchison, Traverse City, MI (US)

( * ) Notice: Subject to any disclaimer, the term of this patent is extended or adjusted under 35 U.S.C. 154(b) by 562 days.

(21) Appl. No.: 13/500,169

(22) PCT Filed: Nov. 10, 2009

(86) PCT No.: PCT/US2009/063800
§ 371 (c)(1),
(2), (4) Date: Jul. 26, 2012

(87) PCT Pub. No.: WO2011/059427
PCT Pub. Date: May 19, 2011

(65) Prior Publication Data
US 2012/0298118 A1 Nov. 29, 2012

(51) Int. Cl.
*A63B 23/03* (2006.01)
*A63B 71/08* (2006.01)

(52) U.S. Cl.
CPC ..... *A63B 23/032* (2013.01); *A63B 71/085* (2013.01); *A63B 2209/00* (2013.01)

(58) Field of Classification Search
USPC ..... 128/848, 859–862; 433/6–7
See application file for complete search history.

(56) References Cited

U.S. PATENT DOCUMENTS

| | | | | |
|---|---|---|---|---|
| 4,718,850 | A | 1/1988 | Knebelman | |
| 4,765,324 | A | 8/1988 | Lake, Jr. | |
| 5,082,007 | A | 1/1992 | Adell | |
| 5,427,117 | A | 6/1995 | Thornton | |
| 5,755,233 | A | 5/1998 | Adell | |
| 5,826,581 | A * | 10/1998 | Yoshida | 128/859 |
| 6,055,986 | A * | 5/2000 | Meade | 128/848 |
| 6,170,485 | B1 | 1/2001 | Orrico | |
| 6,371,758 | B1 | 4/2002 | Kittelsen | |
| 6,691,710 | B2 | 2/2004 | Kittelsen et al. | |
| 6,886,566 | B2 | 5/2005 | Eubank | |
| 2005/0240190 | A1 * | 10/2005 | Gall et al. | 606/72 |
| 2005/0247318 | A1 * | 11/2005 | Mohindra | 128/859 |

FOREIGN PATENT DOCUMENTS

KR 20020026394 A 4/2002

OTHER PUBLICATIONS

International Search Report PCT/US2009/063800 mailed on Sep. 9, 2010.

Abdallah, "Affecting Upper Extremity Strength by Changing Maxillo-Mandibular Vertical Dimension in Deep Bite Subjects", Journal of Craniomandibular Practice, Oct. 2004, vol. 22, No. 4.

(Continued)

*Primary Examiner* — Ophelia A Hawthorne
(74) *Attorney, Agent, or Firm* — Dickinson Wright PLLC

(57) ABSTRACT

A mouth piece assembly (20) for relaxing muscles associated with a jaw of a person having teeth (22). The assembly includes a mouth piece body (24) having a cross-section presenting a pocket (38). The mouth piece body (24) is engaged to the teeth (22) of the person and the person's vertical dimension of occlusion is measured and compared to a predetermined range of 19±2 mm. At least one calibrating member (44) is inserted into the pocket (38) of the mouth piece body (24) to increase the height of the mouth piece body (24) so that the person's vertical dimension of occlusion is increased into the range of 19±2 mm. While wearing the resulting mouth piece assembly (20), the person experiences increased strength, stamina, and balance.

16 Claims, 3 Drawing Sheets

(56) References Cited

OTHER PUBLICATIONS

Smith, "Adjusting Mouthguards Kinesiologically in Professional Football Players", NYS Dental Journal, May 1982.
Chakfa, "The Effect of Stepwise Increases in Vertical Dimension of Occlusion on Isometric Strength of Cervical Flexors and Deltoid Muscles in Nonsymptomatic Females", Journal of Craniomandibular Practice, Oct. 2002, vol. 20, No. 4.
Fink, "The Functional Relationship Between the Craniomandibular System, Cervical Spine, and the Sacroiliac Joint: A Preliminary Investigation", Journal of Craniomandibular Practice, Jul. 3003, vol. 21, No. 3.
Yoshino, "Changes in Weight Distribution at the Feet Due to Occlusal Supporting Zone Loss During Clenching", Journal of Craniomandibular Practice, Oct. 2003, vol. 21, No. 4.
Dau, "Acute Effects of Dental Appliances on Upper and Lower Isokinetic Muscle Function", Biomedical Engineering Department, Wayne State University, Detroit.
Scimone, "Effect of a Mouth Appliance on Athletic Performance", Journal of the Massachusetts Dental Society, p. 156.

* cited by examiner

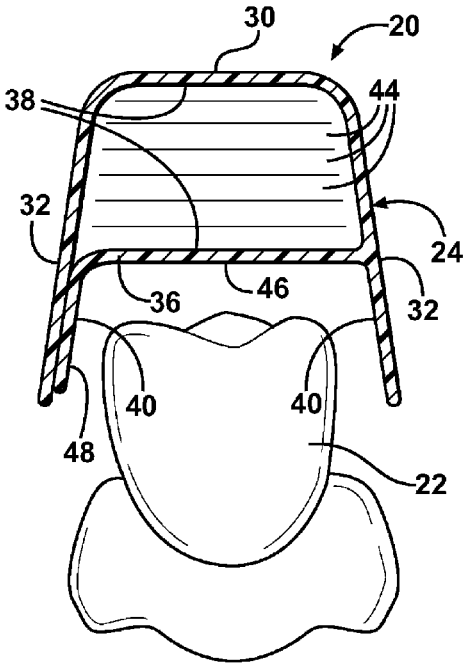
FIG. 3
FIG. 4
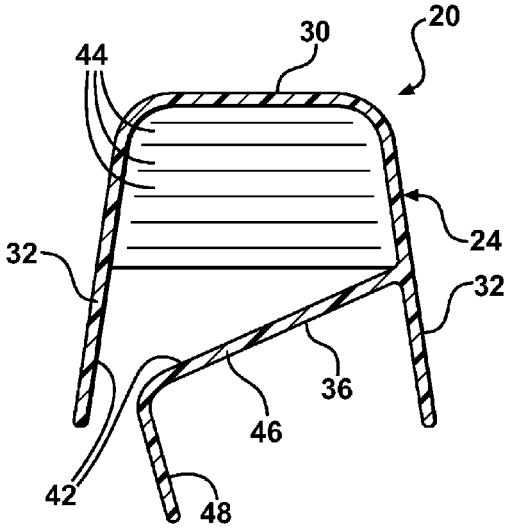
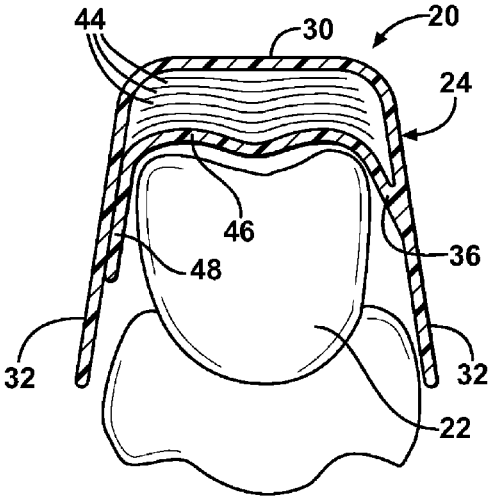
FIG. 5

MOUTH GUARD FOR INCREASING STRENGTH AND STAMINA

CROSS-REFERENCE TO RELATED APPLICATION

This application claims priority to International Application No. PCT/US2009/063800 filed on Nov. 10, 2009, entitled "Mouth Guard for Increasing Strength and Stamina". The entire disclosure of the above application is incorporated herein by reference.

BACKGROUND OF THE INVENTION

1. Field of the Invention

A mouth piece assembly for relaxing muscles associated with a jaw of a person having teeth.

2. Description of the Prior Art

U.S. Pat. No. 5,826,581 (hereinafter referred to as the '581 patent), issued to Nobutaka Yoshida on Oct. 27, 1998, shows a mouth piece assembly including a mouth piece body. As best shown in FIGS. 4 and 5 of the '581 patent, the mouth piece body presents a pocket and a member disposed in that pocket.

The mouth piece assembly of the '581 patent functions to protect the molars of a person. The mouth piece body is formed by molding a resin with an insert piece interposed in an intermediate position. After the resin solidifies, the insert piece is removed to define the pocket. A softenable material is then injected into the pocket and solidified to define the member.

SUMMARY OF THE INVENTION AND ADVANTAGES

The invention provides a mouth piece assembly wherein the mouth piece body includes a retainer in the pocket for receiving and retaining at least one calibrating member in the pocket of the mouth piece body to increase the height of the mouth piece body for increasing the vertical dimension of occlusion of the person into a predetermined range when the person's teeth are clenched against the mouth piece assembly.

The invention improves on the prior art mouth piece assemblies because the calibrating members can be inserted into the pocket of the mouth piece body to customize the height of the mouth piece assembly. The height of the mouth piece assembly can be custom fitted to any person to increase that person's vertical dimension of occlusion into a predetermined range, and thereby, increase that person's strength, stamina, and balance.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3 is a cross-sectional view of the first embodiment of the mouth piece assembly taken along line 3-3 of FIG. 2 and showing a tooth;

FIG. 4 is a cross-sectional view of the first embodiment of the mouth piece assembly similar to FIG. 3 and showing the access to the pocket for inserting and removing the calibrating members to and from the pocket;

FIG. 5 is a cross-sectional view of the first embodiment of the mouth piece assembly similar to FIG. 3 and showing the calibrating members melted and conformed to the teeth of the person;

DETAILED DESCRIPTION OF THE INVENTION

Figure 1:
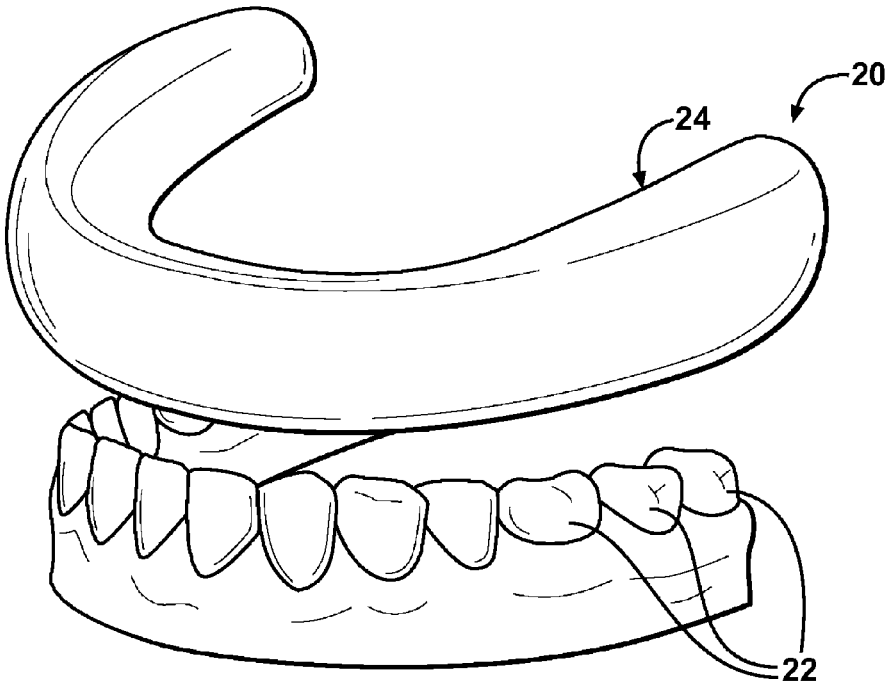
FIG. 1 is a perspective view of the mouth piece assembly.
Figure 2:
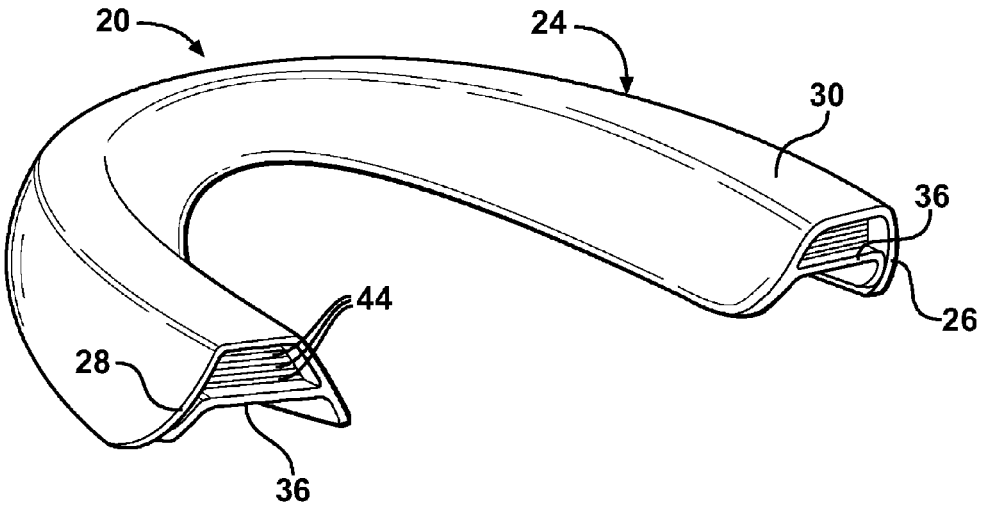
FIG. 2 is a perspective view of a first embodiment of the mouth piece assembly.

Referring to the Figures, wherein like numerals indicate corresponding parts throughout the several views, a mouth piece assembly 20 for relaxing muscles associated with a jaw of a person having teeth 22 is generally shown in FIGS. 1-8. The mouth piece assembly 20 is preferably used on the lower teeth 22 of a person.

The mouth piece assembly 20 includes a mouth piece body 24, generally indicated, extending through a U-shape from a first end 26 to a second end 28. The mouth piece bodies 24 of the exemplary embodiments are of a polymeric material deformable at a temperature above human body temperature. The human body temperature includes those temperatures that the human body might reach during physical activity.

In the exemplary embodiments of FIGS. 1-8, the mouth piece body 24 has a cross-section extending between the first and second ends 26, 28 defining a top wall 30 and a pair of side walls 32 spaced from one another and extending downwardly away from the top wall 30 to distal ends 34. The cross-section further includes a cross-member 36 disposed between the top wall 30 and the distal ends 34 of the side walls 32 and interconnecting the side walls 32 to present a pocket 38. The pocket 38 is defined by the top wall 30, the side walls 32, and the cross-member 36. Additionally, the mouth piece body 24 presents a channel 40 on the lower side of the cross-member 36 opposite the pocket 38 for engaging the lower teeth 22 of the person. It should be appreciated that the pocket 38 of the mouth piece body does not have to be enclosed by the cross-member 36.

The mouth piece body 24 further includes a retainer 36 in the pocket 38 for receiving and retaining at least one calibrating member 44 in the pocket 38 of the mouth piece body 24 to increase the vertical dimension of occlusion of the person with the teeth 22 clenched against the mouth piece body 24 into the range of nineteen plus or minus two millimeters (19±2 mm or 17 to 21 mm). In order to maximize the relaxation of the muscles associated with the jaw and optimize the neurological efficiency for increasing strength, the vertical dimension of occlusion is preferably in the range of 19±2 mm. Relaxing the muscles associated with the jaw and optimizing the neurological efficiency has been found to improve a person's strength, stamina, and balance. The vertical dimension of occlusion is preferably obtained by measuring the distance from the gum line at the upper central incisor to the gum line at the lower central incisor when the teeth 22 are clenched against the mouth piece body 24.

Similar to the mouth piece body 24, the calibrating members 44 are of a material deformable at a temperature greater than the human body temperature. Once the calibrating members 44 have been inserted into the pocket 38 of the mouth piece body 24, the mouth piece assembly 20 is submerged in hot water at a temperature above the human body temperature (preferably above 110 degrees Fahrenheit) for thirty to sixty (30-60) seconds to heat and melt the calibrating members 44 and the mouth piece body 24. Once heated, the mouth piece assembly 20 is submerged in cold water for approximately five (5) seconds and quickly inserted into the mouth of the person. The teeth 22 of the person are then clenched on the mouth piece body 24 to conform the mouth piece body 24 and the calibrating members 44 to the teeth 22 of the person. The mouth piece body 24 and calibrating members 44 will reharden in the conformed position to provide a comfortable mouth piece assembly 20 that is custom-fitted to give that person a vertical dimension of occlusion in the range of 19±2 mm.

FIGS. 2-5 show a first embodiment of the mouth piece assembly 20. Referring to FIG. 3, the cross-member 36 of the mouth piece body 24 has a cross-section presenting an L-shape including a long leg 46 integrally connected to one of the side walls 32. The long leg 46 extends in parallel relationship with the top wall 30 to the other side wall 32, and a short leg 48 abuts the other side wall 32 and extends downwardly away from the top wall 30. As can be seen in FIG. 4, the L-shaped cross-member 36 can be pulled downwardly to present an access 42 for inserting the calibrating members 44 into the pocket 38 of the mouth piece body 24. FIG. 5 shows the mouth piece body 24 and the calibrating members 44 after being melted and conformed to the teeth 22 of the person in the process described above.

Figure 6:
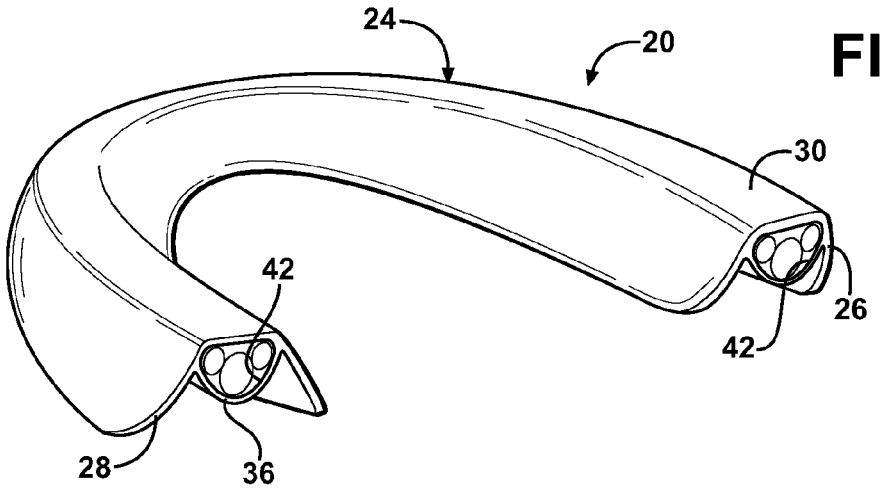
FIG. 6 is a perspective view of a second embodiment of the mouth piece assembly.
Figure 7:
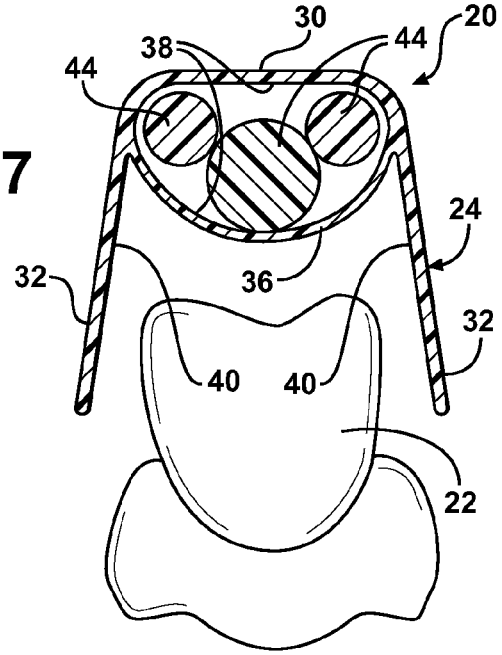
FIG. 7 is a cross-sectional view of the second embodiment taken along line 7-7 of FIG. 6 and showing a tooth.
Figure 8:
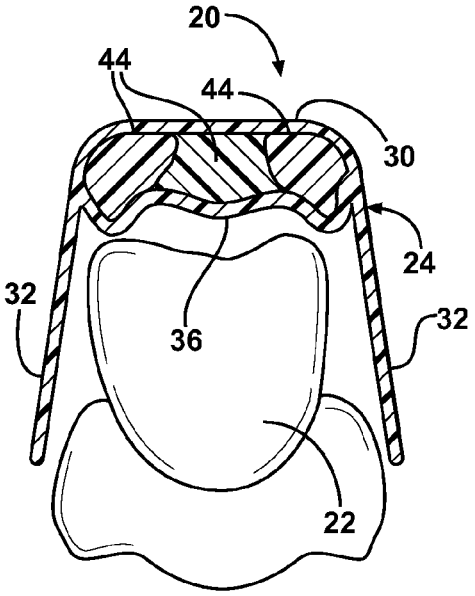
FIG. 8 is a cross-sectional view of the second embodiment of the mouth piece assembly similar to FIG. 7 and showing the calibrating members melted and conformed to the teeth of the person.

FIGS. 6-8 show a second embodiment of the mouth piece assembly 20. As best shown in FIG. 7, before being melted and conformed to the teeth 22 of the person, each of the calibrating members 44 of the second embodiment has a tubular shape, and the cross-member 36 arcs downwardly away from the top wall 30. As shown in FIG. 6, both the first and second ends 26, 28 of the mouth piece body 24 are open to define the access 42 for inserting the calibrating members 44 into the pocket 38 of the mouth piece body 24. Upon entering the access 42, the calibrating members 44 snake through the pocket 38 to the position shown in FIG. 6. FIG. 8 shows the calibrating members 44 after being melted and conformed to the teeth 22 of the person in the process described above. It should be appreciated that the cross-member 36 is just an exemplary embodiment of the retainer, and that other means may be used as the retainer, for example, buttons, notches, or a friction material in the mouth piece body 24 for holding the calibrating members 44 in the pocket 38 of the mouth piece body 24.

A method for relaxing muscles associated with a jaw of a person having teeth 22 using a mouth piece assembly 20 is further included. The mouth piece assembly 20 includes a mouth piece body 24 of a polymeric material deformable at a temperature above human body temperature formed into a U-shape extending between a first end 26 and a second end 28. The mouth piece body 24 of the exemplary embodiments further has a cross-section extending between the first and second ends 26, 28 defining a top wall 30 and a pair of side walls 32 extending downwardly away from the top wall 30 and a cross-member 36 disposed between the top wall 30 and the distal ends 34 and interconnecting the side walls 32 to present a pocket 38 defined by the top wall 30, the side walls 32, and the cross-member 36. The cross-section further presents a channel 40 on the lower side of the cross-member 36 opposite the pocket 38 for engaging the lower teeth 22 of the person.

The method begins with the step of measuring the vertical dimension of occlusion of the person with the teeth 22 being clenched. As explained above, the vertical dimension of occlusion is obtained by measuring the distance from the gum line of the upper central incisor to the gum line of the lower central incisor when the teeth 22 are clenched. The method continues with the step of comparing the measured vertical dimension of occlusion of the person to a predetermined range of 19±2 mm. The method continues with the step of inserting at least one calibrating member 44 into the pocket 38 of the mouth piece body 24 for increasing the vertical dimension of occlusion of the person into the predetermined range when the person's teeth 22 are clenched against the mouth piece body 24. Similar to the mouth piece body 24, each of the calibrating members 44 is of a material deformable at a temperature greater than the human body temperature and has a predetermined thickness. The calibrating members 44 of the exemplary embodiments each have a thickness of one to two (1-2) mm, but any other thickness can be used. When determining the number of calibrating members 24 to insert into the pocket 38 of the mouth piece body 24, the thickness of the mouth piece body 24 should be accounted for. For example, if the measured vertical dimension of occlusion of the person is 13 mm, the thickness of the mouth piece body 24 is 2 mm, and each of the calibrating members 44 is 2 mm thick, then two calibrating members 44 should be inserted into the pocket 38 of the mouth piece body 24 to increase the vertical dimension of occlusion of the person with the teeth 22 clenched against the mouth piece body 24 to 19 mm.

In the first embodiment if the mouth piece assembly 20, the method further includes the step of pulling the short leg 48 downwardly to move the long leg 46 to provide the access 42 for inserting the calibrating members 44 into the pocket 38 of the mouth piece body 24.

In the second embodiment of the mouth piece assembly 20, at least one of the first and second ends 26, 28 of the mouth piece body 24 is open to provide the access 42 for inserting the calibrating members 44 into the pocket 38 of the mouth piece body 24.

When the correct number of calibrating members 44 are inserted into the pocket 38 of the mouth piece body 24, the method continues with the step of heating the mouth piece body 24 in water at a temperature greater than the human body temperature (preferably at 110 degrees Fahrenheit) for 30-60 seconds to soften and melt the material of the mouth piece body 24 and the calibrating members 44. Once heated, the mouth piece body 24 continues with the step of cooling the mouth piece body 24 in cool water for approximately 5 seconds. The method is completed with the step of engaging the mouth piece body 24 to the teeth 22 of the person to conform the mouth piece body 24 and the calibrating members 44 to the teeth 22 of the person in response to the teeth 22 of the person being clenched against the mouth piece body 24.

EXAMPLE

A study was conducted comparing the strength of the test subjects under four different conditions: without a mouth piece and with their teeth unclenched (unclenched); without a mouth piece assembly and with their teeth clenched (clenched); with a common mouth guard (common mouth guard); and with the mouth piece assembly of the exemplary embodiment (exemplary mouth piece assembly). The common mouth guard was fitted to the test subjects according to the manufacturer's specifications. The mouth piece assembly of the exemplary embodiment was formed and fitted to the test subjects using the method described above so that the test subjects each had a vertical dimension of occlusion in the range of 19 plus or minus 2 mm.

The test subjects participated in upper body and lower body strength tests under each of the above conditions. The upper body test was an elbow flexion/extension, and the lower body test was a knee extension/flexion. Prior to the testing, each of the subjects was warmed up and the testing machine was properly calibrated. The order of testing each of the above conditions was randomized. Each of the subjects did sets of five repetitions for each of the above conditions with a three minute rest period between each of the sets. Four criteria were measured during each test: peak torque/body weight (PT/BW), max repetition work (MRW), total work (TW), and average power (AP). The data was then normalized with unclenched teeth position used as the baseline. The other three conditions were evaluated as improvements (positive) or degradations (negative) from the unclenched position. Below are charts depicting the results of the upper body and lower body strength tests.

| Upper Body | | | | |
|---|---|---|---|---|
| Condition | PT/BW (%) | RW (ft-lbs) | TW (ft-lbs) | AP (watts) |
| Unclenched | 0 | 0 | 0 | 0 |
| Clenched | 1.25 | 2.94 | 18.87 | 2.65 |
| Common Mouth Guard | 1.63 | 4.06 | 16.33 | 4.22 |
| Exemplary Mouth Piece Assembly | 2.35 | 6.12 | 30.94 | 6.12 |

| Lower Body | | | | |
|---|---|---|---|---|
| Condition | PT/BW (%) | RW (ft-lbs) | TW (ft-lbs) | AP (watts) |
| Unclenched | 0 | 0 | 0 | 0 |
| Clenched | 0.15 | −0.46 | 3.70 | 2.65 |
| Common Mouth Guard | 1.97 | 2.97 | 25.86 | 6.15 |
| Exemplary Mouth Piece Assembly | 4.82 | 14.77 | 83.64 | 16.01 |

As can be seen from the above tables, the mouth piece assembly of the exemplary embodiment provided a significant increase in strength in both the upper body and lower body tests when compared to the other three conditions. The mouth piece assembly of the exemplary embodiment has also been found to provide similar benefits to the user's balance and stamina.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A customizable mouth piece assembly (20) for relaxing muscles associated with jaws of people who have teeth (22) and have a range of differently sized mouths, comprising:

a mouth piece body (24) having a cross-section presenting a pocket (38), a plurality of calibrating members (44) of predetermined thicknesses, and said mouth piece body (24) including a retainer (36) in said pocket (38) for receiving and retaining at least one of said calibrating members (44) in said pocket (38) of said mouth piece body (24) to increase a height of said mouth piece body (24) for increasing a vertical dimension of occlusion of the person with the teeth (22) clenched against the mouth piece body (24) in a predetermined range of 19±2 mm.

2. The customizable mouth piece assembly (20) as set forth in claim 1 wherein said mouth piece body (24) has a cross-section defining a top wall (30) and a pair of side walls (32) spaced from one another and extending downwardly away from said top wall (30) to distal ends (34) and a cross-member (36) defining said retainer and disposed between said top wall (30) and said distal ends (34) and interconnecting said side walls (32) to close said pocket (38) between said top wall (30) and said side walls (32) and said cross-member (36) and to present a channel (40) on the lower side of said cross member (36) opposite said pocket (38) for engaging the teeth (22).

3. The customizable mouth piece assembly (20) as set forth in claim 2 wherein said cross-member (36) is integrally attached to one of said side walls (32) and extends to the other of said side walls to be pulled downwardly away from said top wall (30) to provide an access (42) to said pocket (38) for inserting said at least one calibrating member (44) into said pocket (38).

4. The customizable mouth piece assembly (20) as set forth in claim 3 wherein said cross-member (36) has a cross-section presenting an L-shape including a long leg (46) integrally connected to one of said side walls (32) and extending in parallel relationship with said top wall (30) to the other of said side walls (32) and a short leg (48) abutting the other of said side walls (32) and extending downwardly away from said top wall (30).

5. The customizable mouth piece assembly (20) as set forth in claim 2 wherein said mouth piece body (24) defining a U-shape from a first end (26) to a second end (28) and at least one of said first and second ends (26, 28) of said mouth piece body (24) is open for inserting said calibrating members (44) into said pocket (28) of said mouth piece body (24).

6. The customizable mouth piece assembly (20) as set forth in claim 1 wherein said mouth (24) is of a material deformable at a temperature above human body temperature.

7. A method for relaxing muscles associated with a jaw of a person having lower teeth (22) with a mouth piece body (24) having a cross-section defining a pocket (38), comprising the steps of:

measuring a vertical dimension of occlusion of the person with the teeth (22) clenched, comparing the measured vertical dimension of occlusion of the person to a predetermined range, inserting at least one calibrating member (44) having a predetermined thickness and of a material deformable at a temperature greater than human body temperature into the pocket (38) of the mouth piece body (24) to increase a height of the mouth piece body (24) for increasing the vertical dimension of occlusion of the person with the teeth (22) clenched against the mouth piece body (24) in a predetermined range of 19±2 mm.

8. The method as set forth in claim 7 wherein the cross-member (36) of the mouth piece body (24) is integrally connected to one of a pair of side walls (32) and further including the step of pulling the cross-member (36) downwardly to provide an access (42) for inserting the at least one calibrating member (44) into the pocket (38) of the mouth piece body (24).

9. The method as set forth in claim 7 wherein the mouth piece body (24) presents first and second ends (26, 28) and one of the first and second ends (26, 28) is open to provide an access (42) for inserting the at least one calibrating member (44) into the pocket (38).

10. The method as set forth in claim 7 further including the steps of heating the mouth piece body (24) with the at least one calibrating member (44) disposed in the pocket (38) in water above the human body temperature and cooling the mouth piece body (24) and engaging the mouth piece body (24) to the teeth (22) of the person to conform the mouth piece body (24) and the at least one calibrating member (44) to the teeth (22) of the person in response to the teeth being clenched against the mouth piece body (24).

11. A mouth piece assembly (20) for relaxing muscles associated with a jaw of a person having lower teeth (22), comprising:

a mouth piece body (24) of a polymeric material deformable at a temperature above human body temperature defining a U-shape from a first end (26) to a second end (28), said mouth piece body (24) having a cross-section extending between said first and second ends (26, 28) defining a top wall (30) and a pair of side walls (32) spaced from one another and extending downwardly away from said top wall (30) to distal ends (34) and a cross-member (36) disposed between said top wall (30) and said distal ends (34) and interconnecting said side walls (32) to present a pocket (38) defined by said top wall (30) and said side walls (32) and said cross-member (36) and to present a channel (40) on the lower side of said cross-member (36) opposite said pocket (38) for engaging the lower teeth (22) of the person, said mouth piece body (24) including a retainer (36) defined by said cross-member for receiving and retaining at least one calibrating member (44) in said pocket (38) of said mouth piece body (24) to increase a vertical dimension of occlusion of the person with the teeth (22) clenched against the mouth piece body (24) in a predetermined range of 19±2 mm, and the at least one calibrating member (44) being of a material deformable at a temperature above human body temperature.

12. The mouth piece assembly (20) as set forth in claim 11 wherein said cross-member has a cross-section presenting an L-shape including a long leg (46) integrally connected to one of said side walls (32) and extending in parallel relationship with said top wall (30) to the other of said side walls (32) and a short leg (48) abutting the other of said side walls (32) and extending downwardly away from said top wall (30) to be pulled downwardly away from said top wall (30) to provide an access (42) to said pocket (38) for inserting the at least one calibrating member (44) into said pocket (38).

13. The mouth piece assembly (20) as set forth in claim 11 wherein the at least one calibrating member (44) has a tubular shape and wherein said cross-member arcs downwardly away from said top wall (30) between said side walls (32) and wherein at least one of said first and second ends (26, 28) of said mouth piece body is open to define said access (42) to said pocket (38) for inserting and removing said at least one calibrating member (44).

14. A method for relaxing muscles associated with a jaw having lower teeth (22) with a mouth piece body (24) of a material deformable at a temperature above human body temperature formed into a U-shape extending between a first end (26) and a second end (28) and wherein the mouth piece body (24) has a cross-section extending between the first and second ends (26, 28) defining a top wall (30) and a pair of side walls (32) extending downwardly away from the top wall (30) and a cross-member (36) disposed between the top wall (30) and the distal ends (34) and interconnecting the side walls (32) to present a pocket (38) defined by the top wall (30) and the side walls (32) and the cross-member (36) and to present a channel (40) on the lower side of the cross-member (36) opposite the pocket (38) for engaging the lower teeth (22) of the person, comprising the steps of:

measuring a vertical dimension of occlusion of the person with the teeth (22) of the person being clenched, comparing the measured vertical dimension of occlusion of the person to a predetermined range, inserting at least one calibrating member (44) of a material deformable at a temperature above human body temperature and having a predetermined thickness into the pocket (38) of the mouth piece body (24) to increase a height of the mouth piece body (24) for increasing the vertical dimension of occlusion of the person with the teeth (22) clenched against the mouth piece body (24) in a predetermined range of 19±2 mm, heating the mouth piece body (24) in hot water for a predetermined duration of time, cooling the mouth piece body (24) in cool water, and engaging the mouth piece body (24) to the teeth (22) of the person to conform the mouth piece body (24) and the at least one calibrating member (44) to the teeth (22) of the person in response to the teeth being clenched against the mouth piece body (24).

15. The method as set forth in claim 14 wherein the cross-member (36) of the mouth piece body (24) has a cross-section presented an L-shape including a long leg (46) integrally connected to one of the side walls (32) and extending in parallel relationship with the top wall (30) to the other side wall (32) and having a short leg (48) abutting the other side wall (32) and extending downwardly away from the top wall (30), and further including the step of pulling the short leg (48) downwardly to move the long leg (46) to provide an access (42) for inserting the at least one calibrating member (44) into the pocket (38) of the mouth piece body (24).

16. The method as set forth in claim 14 wherein the at least one calibrating member (44) has a tubular shape and wherein the cross-member (36) arcs downwardly away from the top wall (30), wherein at least one of the first and second ends (26, 28) of the mouth piece body (24) is open to provide an access (42) for inserting the at least one calibrating member (44) into the pocket (38) of the mouth piece body (24), and wherein the step of inserting the at least one calibrating member (44) is further defined as inserting at least one additional calibrating member into the pocket (38) of the mouth piece body (24) through the access (42) on one of the first and second ends (26, 28).

* * * * *